US011925206B2

(12) United States Patent
Lin et al.

(10) Patent No.: US 11,925,206 B2
(45) Date of Patent: Mar. 12, 2024

(54) ELECTRONIC CIGARETTE HAVING DUAL AIR PASSAGES

(71) Applicant: HUIZHOU HAPPY VAPING TECHNOLOGY LIMITED, Guangdong (CN)

(72) Inventors: Guangrong Lin, Guangdong (CN); Xianbin Zheng, Guangdong (CN)

(73) Assignee: HUIZHOU HAPPY VAPING TECHNOLOGY LIMITED, Huizhou (CN)

( * ) Notice: Subject to any disclaimer, the term of this patent is extended or adjusted under 35 U.S.C. 154(b) by 507 days.

(21) Appl. No.: 17/419,352

(22) PCT Filed: Dec. 5, 2019

(86) PCT No.: PCT/CN2019/123185

§ 371 (c)(1),
(2) Date: Jun. 29, 2021

(87) PCT Pub. No.: WO2020/151376

PCT Pub. Date: Jul. 30, 2020

(65) Prior Publication Data

US 2022/0079227 A1 Mar. 17, 2022

(30) Foreign Application Priority Data

Jan. 24, 2019 (CN) ..... 201910068880.9

(51) Int. Cl.
*A24F 40/42* (2020.01)
*A24F 40/46* (2020.01)
(Continued)

(52) U.S. Cl.
CPC ..... *A24F 40/42* (2020.01); *A24F 40/46* (2020.01); *A24F 40/485* (2020.01); *A24F 40/51* (2020.01)

(58) Field of Classification Search
CPC ..... A24F 40/42; A24F 40/46; A24F 40/485; A24F 40/51; A24F 40/10
See application file for complete search history.

(56) References Cited

U.S. PATENT DOCUMENTS

2020/0046021 A1* 2/2020 Sur ..... A24F 40/90
2020/0237007 A1* 7/2020 Qiu ..... H02J 7/00

FOREIGN PATENT DOCUMENTS

CN 206251933 U 6/2017
CN 206507312 U 9/2017
(Continued)

OTHER PUBLICATIONS

International Search Report of PCT Patent Application No. PCT/CN2019/123185 dated Mar. 3, 2020.

*Primary Examiner* — Jean F Duverne

(57) ABSTRACT

The disclosure provides an electronic cigarette having dual air passages. Inside the battery rod, a first suction sensing air passage is provided to communicate with the suction sensor. The second air inlet passage is centrally provided on the vaporizing base and extends therethrough. The second air inlet cavity which is in communication with the second air inlet passage is formed between the vaporizing base and the bottom cap. The first air inlet cavity is formed between the bottom portion of the bottom cap and the top portion of the receiving portion. The bottom portion of the bottom cap is provided with the first air inlet passage for communicating the first air inlet cavity with the second air inlet cavity. The bottom portion of the bottom cap is further provided with the second suction sensing air passage for communicating the second air inlet cavity with the first suction sensing air passage.

10 Claims, 5 Drawing Sheets

(51) Int. Cl.
*A24F 40/485* (2020.01)
*A24F 40/51* (2020.01)

(56) References Cited

FOREIGN PATENT DOCUMENTS

| | | | | | | |
|---|---|---|---|---|---|---|
| CN | 108158044 | A | | 6/2018 | | |
| CN | 108576939 | A | * | 9/2018 | ..... | A24F 47/008 |

* cited by examiner

ELECTRONIC CIGARETTE HAVING DUAL AIR PASSAGES

TECHNICAL FIELD

The disclosure relates to the field of electronic cigarettes, more particularly to an electronic cigarette having dual air passages.

BACKGROUND

The detachable electronic cigarette usually comprises a vaporizer and a battery rod, wherein the vaporizer is provided with a liquid storage chamber for storing electronic cigarette liquid and with a vaporizing device for heating and vaporizing the electronic cigarette liquid.

Chinese patent application CN108158044A discloses an electronic cigarette with a vaporizer having dual cavities and dual air passages. It comprises a vaporizer and a battery rod which are detachably connected, wherein the vaporizer comprises a housing, a vaporizing device and a bottom cap. A partitioning portion dividing the inner cavity of the housing into a large cavity and a small cavity is provided inside the housing on one side. The upper part of the vaporizing device is sheathed in the large cavity, and the lower part of the vaporizing device abuts against the lower inner wall of the housing. A first air outlet pipe provided in the small cavity, an air outlet through-hole provided in the vaporizing device, and a second air outlet pipe provided in the battery rod are connected in sequence to form a first suction sensing air passage. The air intake hole, the air inlet passage, the air inlet cavity, the vaporizing chamber, the vapor tube, and the vapor outlet hole, which are arranged in the housing, are sequentially communicated with each other to form a vapor passage.

The deficiency of the abovementioned electronic cigarette is that, as the first suction sensing air passage extending from the mouth piece end to the battery rod forms a very long air passage, the partitioning portion has to be provided to divide the housing into two portions. Thus, the space inside the housing which is available for storing the electronic cigarette liquid is reduced, and the reduction in the amount of the electronic cigarette liquid directly leads to a shorter service life of the vaporizer.

SUMMARY

Technical Problem

An object of the disclosure is to provide an electronic cigarette having dual air passages, which is structurally improved to comprise dual air passages such that the automatic control for the electronic cigarette during working may be achieved depending on the magnitude of the suction force detected by the first suction sensing air passage. Further, the dual air passages of the electronic cigarette do not take up or reduce the volume of the liquid storage chamber inside the vaporizer.

Technical Solutions

The disclosure provides a technical solution as follow. The electronic cigarette having dual air passages comprises a vaporizer and a battery rod, wherein the vaporizer is provided with a plug-in portion, the battery rod is provided with a receiving portion, and the vaporizer and the battery rod are connected by insertion of the plug-in portion into the receiving portion. Inside the battery rod, a suction sensor is provided. The upper portion of the battery rod is provided with a first suction sensing air passage extending downwardly to communicate with the suction sensor. The vaporizer comprises a mouth piece, a cigarette liquid cup, and a vaporizing device. Herein, the mouth piece is sleeved on the outer wall of the upper portion of the cigarette liquid cup, and the vaporizing device is sleeved upwardly in the inner wall of the lower portion of the cigarette liquid cup. A vapor outlet tube is centrally provided inside the cigarette liquid cup. The vapor outlet tube is in communication with a mouthpiece opening formed on the upper end of the mouth piece. The vaporizing device comprises a liquid isolation component, a vaporizing tube, a heating assembly, a throttle plate, a vaporizing base, and a bottom cap, which are connected in sequence from top to bottom. The vaporizing tube is connected with a lower end of the vapor outlet tube. The liquid isolation component is connected at a joint between the vaporizing tube and the vapor outlet tube, to provide sealing. An inner space of the cigarette liquid cup above the throttle plate forms the liquid storage chamber for storing cigarette liquid. The second air inlet passage extending through the vaporizing base in the vertical direction is centrally provided in the vaporizing base. The second air inlet cavity which is in communication with the second air inlet passage is formed between the vaporizing base and the bottom cap. The lower portion of the cigarette liquid cup is formed as the plug-in portion. The air inlet gap is formed where the plug-in portion and the receiving portion are connected. The first air inlet cavity is formed between the bottom portion of the bottom cap and the top portion of the receiving portion. The bottom portion of the bottom cap is provided with the first air inlet passage for communicating the first air inlet cavity with the second air inlet cavity. The bottom portion of the bottom cap is further provided with the second suction sensing air passage for communicating the second air inlet cavity with the first suction sensing air passage.

Preferably, the wall portion of the receiving portion may be provided with an air intake hole for communicating with the air inlet gap.

Preferably, the second suction sensing air passage may be provided on one side of the bottom cap. The first suction sensing air passage may be symmetrically disposed on two sides of the upper portion of the battery rod and respectively in communication with the suction sensor.

Preferably, a liquid absorbent layer for absorbing droplets contained in the vapor may be provided between the top end of the cigarette liquid cup and the lower portion of the mouth piece.

Preferably, the inner diameter of the vapor outlet tube may gradually become greater from bottom to top, such that the velocity of the vapor flowing out can be decreased, thereby preventing the moisture contained in the vapor from forming droplets on the wall of the tube.

Preferably, the heating assembly may comprise a liquid guiding strip and a heating coil disposed on the liquid guiding strip. A protruding portion may be provided in the middle of the upper portion of the vaporizing base, and the heating assembly may be hung above the second air inlet passage of the protruding portion. The lower portion of the vaporizing tube may be sleeved on the outer wall of the protruding portion of the vaporizing base. The vaporizing chamber for vaporizing the cigarette liquid may be formed inside the vaporizing tube, between the protruding portion and the liquid isolation component.

Preferably, a blind hole may be provided at the bottom portion of the vaporizing base, and the blind hole serves to accommodate the first positive and negative electrodes disposed on the bottom cap. A lead wire for the heating coil of the heating assembly may be arranged within the blind hole, and the lead wire for the heating coil may be connected with the first positive and negative electrodes.

Preferably, the bottom cap may comprise a base plate and comprise a surrounding wall formed on the periphery of the base plate and perpendicular thereto. The first air inlet passage and the second suction sensing air passage may respectively have a tube-shaped body disposed higher than the base plate and lower than the top of the surrounding wall.

Preferably, the bottom cap may be arranged with a liquid filling tube which extends through the vaporizing base and then in communication with the liquid storage chamber. The liquid filling tube may be arranged with a removable plug disposed at the bottom portion of the bottom cap.

Preferably, the outer wall of the vaporizing tube may be directly contacted with the cigarette liquid inside the liquid storage chamber. The vaporizing tube may be made of materials with good heat conductivity, which facilitates transmission of the heat energy inside the vaporizing chamber to the cigarette liquid, to reduce the viscosity of the cigarette liquid having relatively high viscosity.

Advantages

The electronic cigarette having dual air passages, i.e., the first and second air inlet passages and the first and second suction sensing air passages. Herein, the bottom cap of the vaporizing device is provided with the second suction sensing air passage extending downwardly to communicate with the first suction sensing air passage and the suction sensor. Thus, the automatic control for the electronic cigarette during working may be achieved depending on the magnitude of the suction force detected by means of the suction sensor. The second suction sensing air passage does not take up the volume of the liquid storage chamber inside the vaporizer. Thus, the volume of the liquid storage chamber may be maximized to allow increased amount of cigarette liquid to be stored, thereby increasing the service life of the vaporizer. Further, the inner diameter of the vapor outlet tube may gradually become greater from bottom to top, such that the velocity of the vapor flowing out can be decreased, thereby preventing the moisture contained in the vapor from forming droplets on the wall of the tube.

DETAILED DESCRIPTION OF ILLUSTRATED EMBODIMENTS

In order to make purposes, technical solutions and advantages of the disclosure clearer, the disclosure will be further explained in detail with reference to drawings and embodiments described hereinafter.

Figure 6:
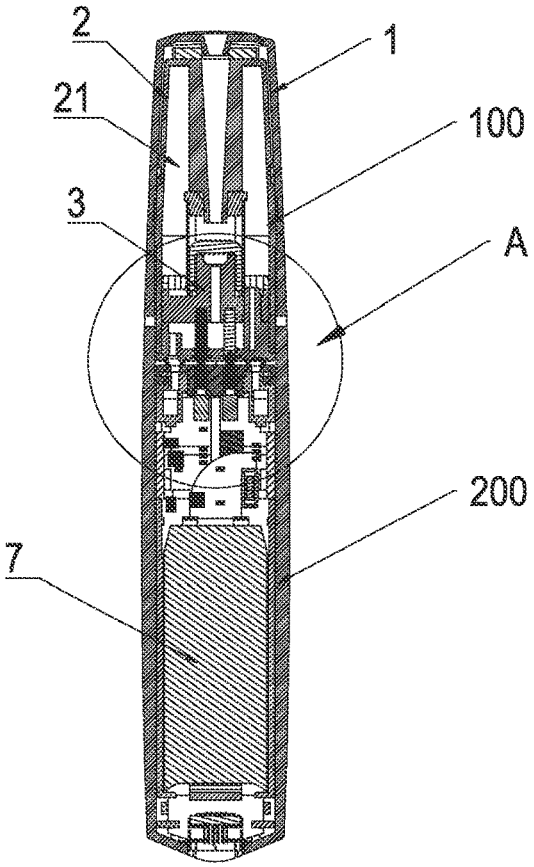
FIG. 6 is a cross-sectional view of an electronic cigarette according to an embodiment of the disclosure.

For convenience of description, the electronic cigarette having dual air passages of the disclosure is illustrated when the electronic cigarette having dual air passages is vertically arranged, with the mouthpiece being located in the upper position, as shown in FIG. 6. The terms, such as "upper", "lower", "upper portion", "lower portion", "upper end", "lower end", "upper surface", "lower surface" "upward", "downward" as used in the disclosure, refer to position and orientation relationships when an electronic cigarette having dual air passages is vertically arranged, with the mouthpiece being located in the upper position.

EMBODIMENTS

Figure 1:
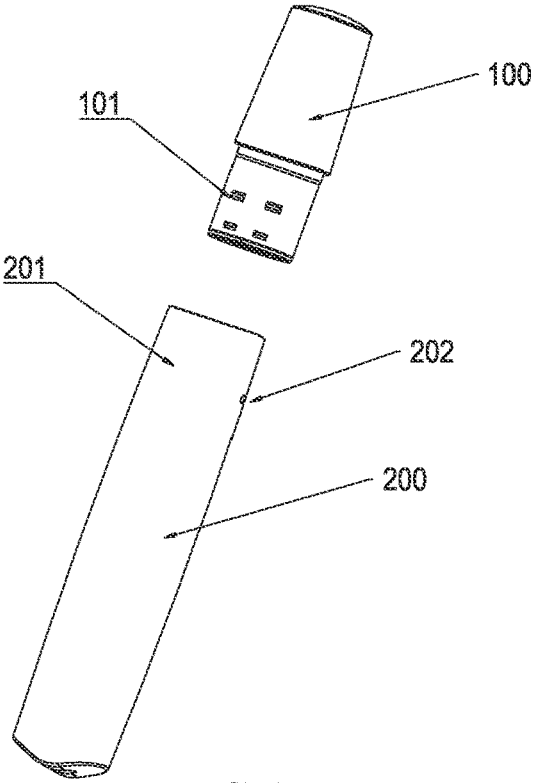
FIG. 1 is a schematic view of an electronic cigarette in a disassembled state according to an embodiment of the disclosure.

Referring to FIG. 1, the disclosure provides an electronic cigarette having dual air passages. The electronic cigarette comprises a vaporizer 100 and a battery rod 200, wherein the vaporizer 100 is provided with a plug-in portion 101, and the battery rod is provided with a receiving portion 201, and the vaporizer 100 and the battery rod 200 are connected by insertion of the plug-in portion 101 into the receiving portion 201.

Figure 2:
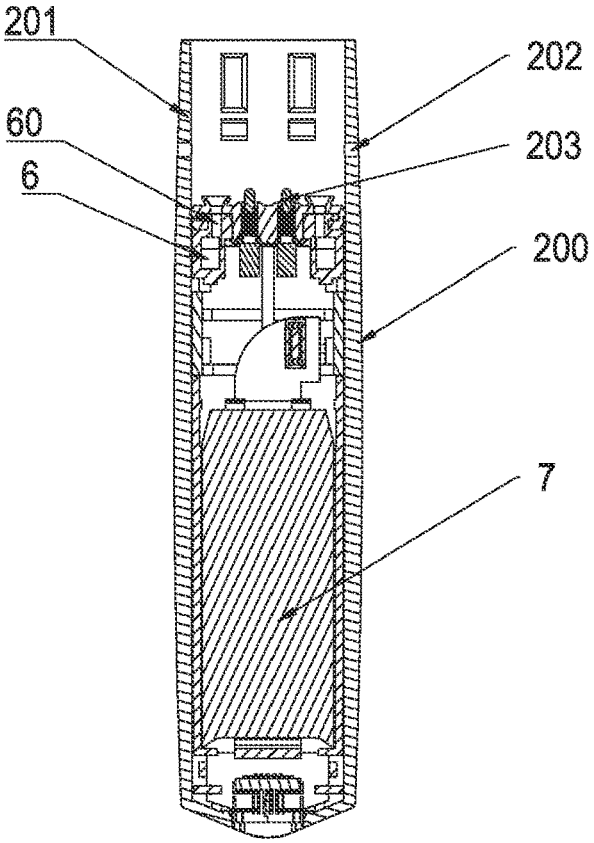
FIG. 2 is a cross-sectional view illustrating a battery rod in an embodiment of the disclosure.

Referring to FIG. 2, inside the battery rod 200, a plurality of components including a battery 7, a control circuit board (not shown in the drawings) and a suction sensor 6 are provided. The upper portion of the battery rod 200 is provided with a first suction sensing air passage 60 extending downwardly to communicate with the suction sensor 6. The suction sensor 6 serves to senses the magnitude of the suction force of the user. That is, during vaping, a negative pressure will be generated inside the vaporizing chamber 30 and the second air inlet cavity 360 described hereinafter, and will be transmitted through the second suction sensing air passage 362 such that the negative pressure will be generated in the first suction sensing air passage 60. During vaping, the operation state may be controlled depending on the magnitude of the negative pressure detected by means of the suction sensor 6.

Figure 3:
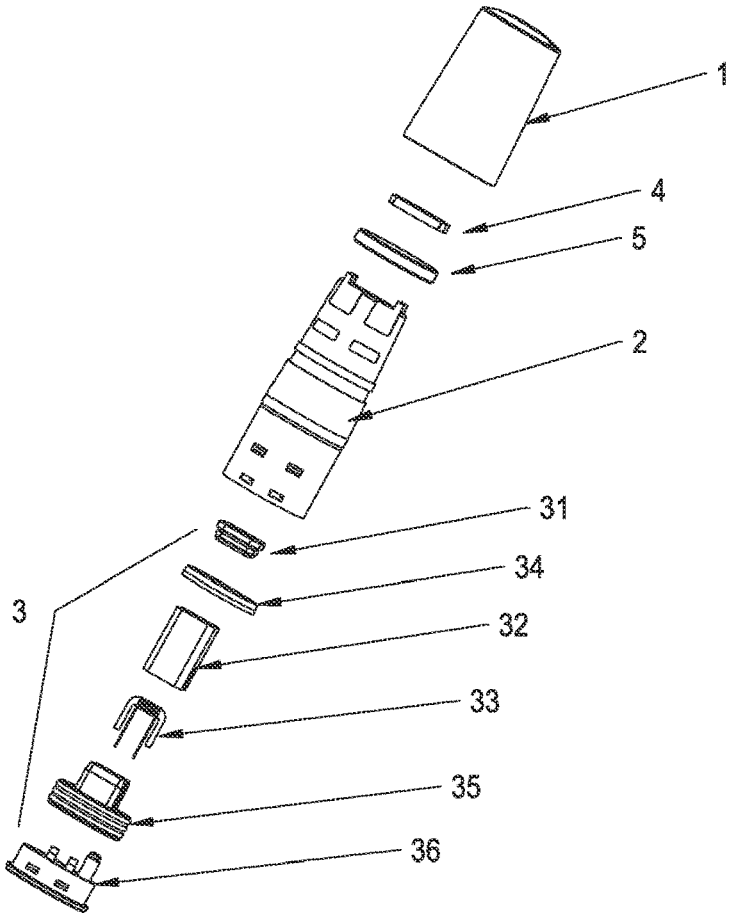
FIG. 3 is an exploded view illustrating a vaporizer in an embodiment of the disclosure.
Figure 4:
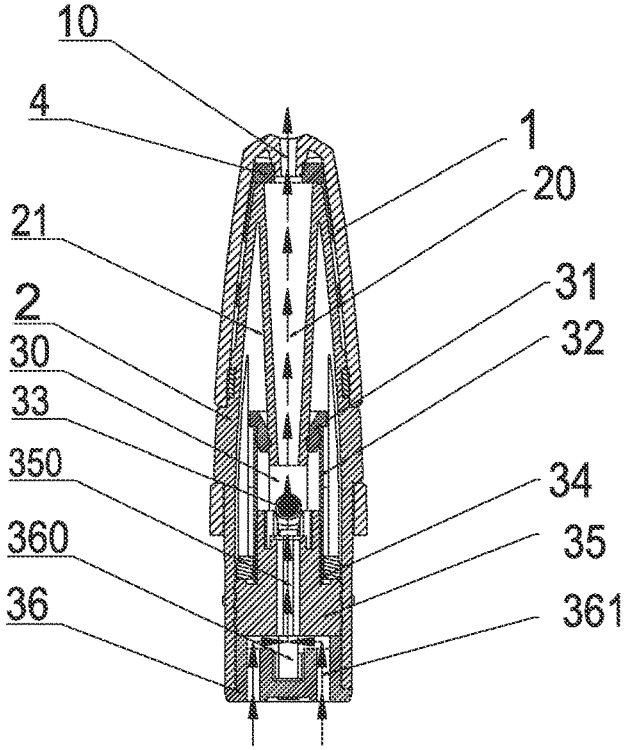
FIG. 4 is a cross-sectional side view illustrating a vaporizer in an embodiment of the disclosure.
Figure 5:
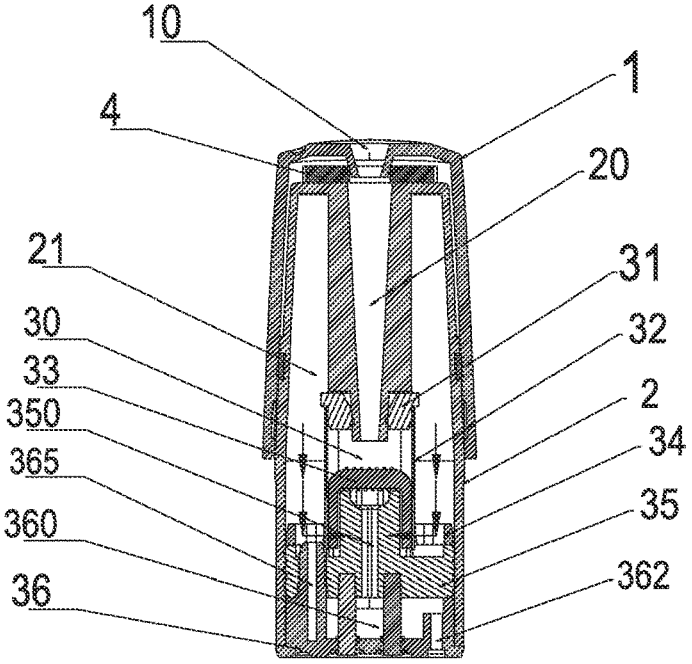
FIG. 5 is a cross-sectional front view illustrating a vaporizer in an embodiment of the disclosure.

Referring to FIGS. 3, 4, and 5, the vaporizer 100 comprises a mouth piece 1, a cigarette liquid cup 2, and a vaporizing device 3. Herein, the mouth piece 1 is sleeved on the outer wall of the upper portion of the cigarette liquid cup 2, and the vaporizing device 3 is sleeved upwardly in the inner wall of the lower portion of the cigarette liquid cup 2. A vapor outlet tube 20 is centrally provided inside the cigarette liquid cup 2. The vapor outlet tube 20 is in communication with a mouthpiece opening 10 formed on the upper end of the mouth piece 1. The vaporizing device 3 comprises a liquid isolation component 31, a vaporizing tube 32, a heating assembly 33, a throttle plate 34, a vaporizing base 35, and a bottom cap 36, which are connected in sequence from top to bottom.

Referring to FIGS. 4-7, the vaporizing tube 32 is connected with a lower end of the vapor outlet tube 20. The liquid isolation component 31 is connected at a joint between the vaporizing tube 32 and the vapor outlet tube 20, to provide sealing. An inner space of the cigarette liquid cup 2 above the throttle plate 34 forms the liquid storage chamber 21 for storing cigarette liquid. A second air inlet passage 350 extending through the vaporizing base 35 in the vertical direction is centrally provided in the vaporizing base 35. The second air inlet cavity 360 which is in communication with the second air inlet passage 350 is formed between the vaporizing base 35 and the bottom cap 36. The lower portion of the cigarette liquid cup 2 is provided with the plug-in portion 101. An air inlet gap 120 is formed where the plug-in portion 101 and the receiving portion 201 are connected. A first air inlet cavity 121 is formed between the bottom cap 36 and the top portion of the receiving portion 201. The bottom portion of the bottom cap 36 is provided with a first air inlet passage 361 for communicating the first air inlet cavity 121 with the second air inlet cavity 360. The bottom portion of the bottom cap 36 is further provided with a second suction sensing air passage 362 for communicating the second air inlet cavity 360 with the first suction sensing air passage 60. The second suction sensing air passage 362 and the first suction sensing air passage 60 are sealingly connected with each other, i.e., the joint therebetween is not in communication with the first air inlet cavity 121. The electronic cigarette of the disclosure comprises dual air passages, i.e., the first and second air inlet passages and the first and second suction sensing air passages. Herein, the bottom cap of the vaporizing device is provided with the second suction sensing air passage extending downwardly to communicate with the first suction sensing air passage and the suction sensor. During working, the automatic control for the electronic cigarette may be achieved depending on the magnitude of the suction force detected by means of the suction sensor. The suction sensing air passage does not take up the volume of the liquid storage chamber inside the vaporizer. Thus, the volume of the liquid storage chamber may be maximized to allow increased amount of cigarette liquid to be stored, thereby increasing the service life of the vaporizer.

Figure 7:
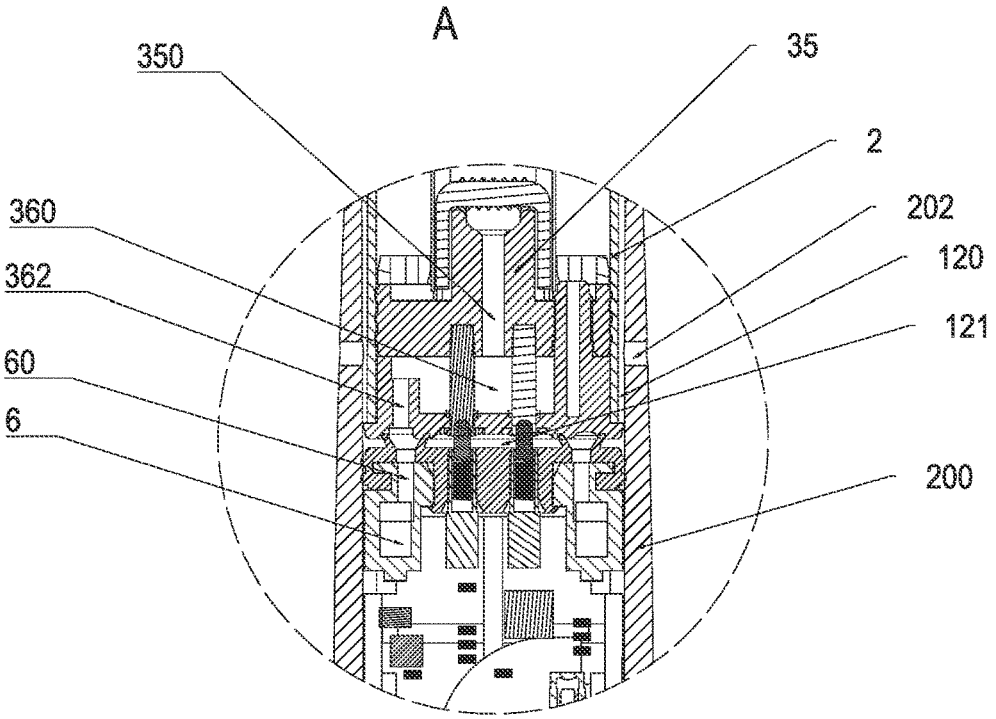
FIG. 7 is an enlarged partial cross-sectional view of an electronic cigarette according to an embodiment of the disclosure.

Referring to FIGS. 1, 2, and 7, the wall portion of the receiving portion 201 is provided with an air intake hole 202 for communicating with the air inlet gap 120, and outside air may flow into the air inlet gap 120 through the air intake hole 202.

Referring to FIGS. 2, 5, and 6, the second suction sensing air passage 362 is provided on one side of the bottom cap 36. The first suction sensing air passage 60 is symmetrically disposed on two sides of the upper portion of the battery rod 200 and respectively in communication with the suction sensor 6. Due to the symmetrical arrangement, in order to achieve connection, it is not necessary for the vaporizer 100 to align to the battery rod 200 by one side. That is, as long as any one side of the vaporizer is connected with the battery rod, the second suction sensing air passage 362 is sealingly connected with one of the first suction sensing air passages 60 on either of the two sides, to facilitate assembling and using of the electronic cigarette.

Referring to FIGS. 3-5, a liquid absorbent layer 4 for absorbing droplets contained in the vapor is arranged between the top end of the cigarette liquid cup 2 and the lower portion of the mouth piece 1, whereby the droplets are prevented from entering the mouth of the user. The liquid absorbent layer 4 may be made of liquid absorbent materials such as sponge, filter cotton and activated carbon. A mouth piece sealing ring 5 is arranged at the joint where the mouth piece 1 and the lower portion of the cigarette liquid cup 2 are connected, to seal the gap between the mouth piece 1 and the cigarette liquid cup 2, avoiding air leakage which may result in failure during vaping.

As shown in FIG. 4, a series of arrows indicate the flowing path of the gas and the vapor during working. During working of the electronic cigarette of the disclosure, i.e., during vaping, outside air flows through the air intake hole 202 into the air inlet gap 120, and then flows into the first air inlet cavity 121, and then flows through the first air inlet passage 361 into the second air inlet cavity 360, and then flows through the second air inlet passage 350 into the vaporizing chamber 30. The cigarette liquid is vaporized in the vaporizing chamber 30, and the vapor is suctioned into the user's mouth through the vapor outlet tube 20 and the mouthpiece opening 10.

As shown in FIG. 5, a series of arrows indicate the path along which the electronic cigarette liquid flows. During working of the electronic cigarette of the disclosure, the electronic cigarette liquid may flow downwardly from the liquid storage chamber 21, through the throttle orifices provided on the throttle plate 34, and to the vaporizing base 35. Then, it may be absorbed by means of the liquid guiding strip 331 and transmitted to the heating coil 332. It may be heated and vaporized by means of the heating coil 332 in the vaporizing chamber 30.

Referring to FIGS. 4 and 5, the inner diameter of the vapor outlet tube 20 gradually becomes greater from bottom to top. Due to the inner diameter of the vapor outlet tube which is gradually increased from bottom to top, the velocity of the vapor flowing out can be decreased, thereby preventing the moisture contained in the vapor from forming droplets on the wall of the tube. Since the end of the vapor outlet tube 20 adjacent to the exit of the vaporizing chamber 30 has the smaller inner diameter, some un-vaporized droplets contained in the vapor may remain in the vaporizing chamber 30 and may be hardly to flow out. Since the end of the vapor outlet tube 20 adjacent to the mouthpiece opening 10 has the greater inner diameter, the velocity of the vapor suctioned out can be decreased in the vapor outlet tube 20. Thus, the moisture contained in the vapor can hardly be condensed on the inner wall of the vapor outlet tube 20 to form droplets that may enter the user's mouth. In this way, the quality of the vapor to be inhaled by the user is improved.

Figure 8:
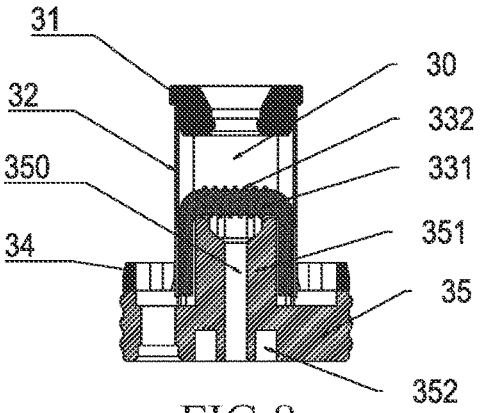
FIG. 8 is a cross-sectional view illustrating a vaporizing device in an embodiment of the disclosure.
Figure 9:
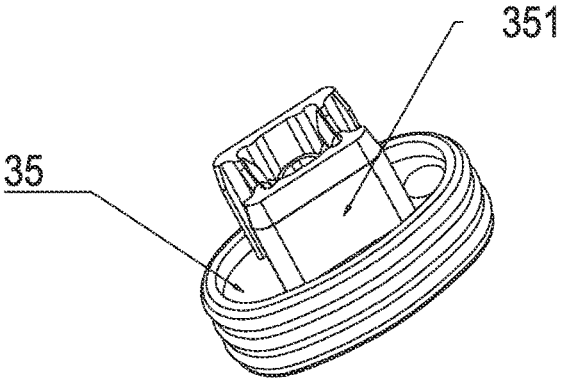
FIG. 9 is a perspective view illustrating a vaporizing base in an embodiment of the disclosure.

Referring to FIGS. 8 and 9, the heating assembly 33 comprises a liquid guiding strip 331 and a heating coil 332 disposed on the liquid guiding strip. A protruding portion 351 having a convex shape is arranged in the middle of the vaporizing base 35, and the heating assembly 33 is hung above the second air inlet passage 350 of the protruding portion 351 of the vaporizing base. The lower portion of the vaporizing tube 32 is sleeved on the outer wall of the protruding portion of the vaporizing base 35. The vaporizing chamber 30 for vaporizing the cigarette liquid is formed inside the vaporizing tube 32, between the protruding portion 351 and the liquid isolation component 31.

Referring to FIGS. 4, 5 and 8, the outer wall of the vaporizing tube 32 is directly contacted with the cigarette liquid inside the liquid storage chamber. The vaporizing tube 32 is made of a material with good heat conductivity, such as metals and stainless steel, to facilitate transmission of the heat energy, which is generated inside the vaporizing chamber 30 during working, to the cigarette liquid. During working, the cigarette liquid may be preheated to reduce the viscosity thereof, thereby facilitating flowing of the cigarette liquid and facilitating absorption and transmission by means of the liquid guiding strip 33. Thus, it is possible for such electronic cigarette to hold and use high viscosity cigarette liquid or waxy cigarette liquid.

Referring to FIG. 8, the vaporizing base 35 is provided at its bottom with a blind hole 352 for accommodating the first positive and negative electrodes 366 disposed on the bottom cap 36. A lead wire for the heating coil 332 of the heating assembly is arranged within the blind hole 352, and the lead wire is connected with the first positive and negative electrodes 366. The vaporizing base 35 usually is made of silica gel material which is resistant to high temperature. After a long period of operation at high temperature, the vaporizing base 35 made of silica gel material may soften, deform, and get loose. As the first positive and negative electrodes 366 are inserted in the blind hole 352, the vaporizing base 35 may be well supported and fixed.

Referring to FIGS. 8 and 9, the liquid isolation component 31 and the vaporizing base 35 are made of soft material which is resistant to high temperature, and their outer walls are respectively provided with a plurality of protruding rings to improve sealing performance.

Figure 10:
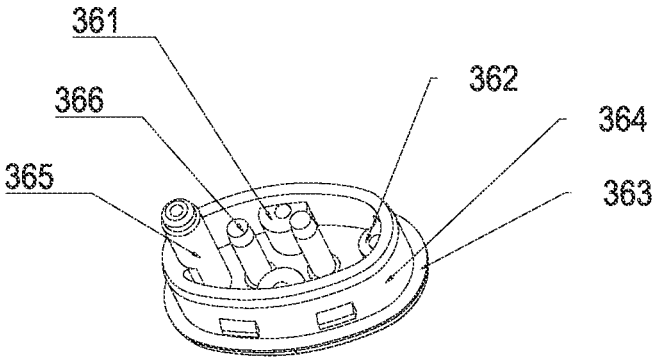
FIG. 10 is a perspective view illustrating a bottom cap in an embodiment of the disclosure.

Referring to FIG. 10, the bottom cap 36 comprises a base plate 363 and comprises a surrounding wall 364 formed on the periphery of the base plate and perpendicular thereto. The first air inlet passage 361 and the second suction sensing air passage 362 respectively have a tube-shaped body higher than the base plate 363 and meanwhile lower than the top of the surrounding wall 364. In this way, a groove having a certain depth is formed at the bottom portion of the bottom cap. The groove may serve to collect and store un-vaporized cigarette liquid droplets that are leaked or dropped from above. It prevents the droplets from entering the user's mouth to result in poor user experience, and also prevents the cigarette liquid droplets from flowing into the battery rod 200 to result in corrosion and damage of the circuits and control boards inside the battery rod 200. The bottom cap 36 is arranged with a liquid filling tube 365 which extends through the vaporizing base 35 and then in communication with the liquid storage chamber 21. The liquid filling tube 365 may be arranged with a removable plug (not shown in the drawings) disposed at the bottom portion of the bottom cap. When the cigarette liquid inside the cigarette liquid cup of the electronic cigarette of the disclosure runs out, the plug may be removed, and the cigarette liquid may be filled into the liquid storage chamber 21 through the liquid filling tube 365. After filling of the cigarette liquid, the plug may be mounted again, to avoid leakage. The first positive and negative electrodes 366 disposed on the bottom cap 36 are connected with the second positive and negative electrodes 203 disposed on the battery rod receiving portion 201. The battery 7 disposed inside the battery rod may supply power to the heating coil by the second positive and negative electrodes and the first positive and negative electrodes 366.

INDUSTRIAL APPLICABILITY

All the above are merely preferred embodiments of the disclosure. The present invention is intended to cover all modifications and equivalent arrangements those skilled in the art can make according to the technical essence of the present invention.

The invention claimed is:

1. An electronic cigarette having dual air passages, comprising a vaporizer and a battery rod, wherein the vaporizer is provided with a plug-in portion, the battery rod is provided with a receiving portion, the vaporizer and the battery rod are connected by insertion of the plug-in portion into the receiving portion, and a suction sensor is provided inside the battery rod, wherein an upper portion of the battery rod is provided with a first suction sensing air passage extending downwardly to communicate with the suction sensor, the vaporizer comprises a mouth piece, a cigarette liquid cup, and a vaporizing device, wherein the mouth piece is sleeved on an outer wall of an upper portion of the cigarette liquid cup, and the vaporizing device is sleeved upwardly in an inner wall of a lower portion of the cigarette liquid cup, a vapor outlet tube is centrally provided inside the cigarette liquid cup, the vapor outlet tube is in communication with a mouthpiece opening formed on an upper end of the mouth piece, the vaporizing device comprises a liquid isolation component, a vaporizing tube, a heating assembly, a throttle plate, a vaporizing base, and a bottom cap, which are connected in sequence from top to bottom, the vaporizing tube is connected with a lower end of the vapor outlet tube, the liquid isolation component is connected at a joint between the vaporizing tube and the vapor outlet tube to provide sealing, an inner space of the cigarette liquid cup above the throttle plate forms a liquid storage chamber for storing cigarette liquid, a second air inlet passage extending through the vaporizing base in a vertical direction is centrally provided in the vaporizing base, a second air inlet cavity which is in communication with the second air inlet passage is formed between the vaporizing base and the bottom cap, a lower portion of the cigarette liquid cup is formed as the plug-in portion, an air inlet gap is formed where the plug-in portion and the receiving portion are connected, a first air inlet cavity is formed between a bottom portion of the bottom cap and a top portion of the receiving portion, the bottom portion of the bottom cap is provided with a first air inlet passage for communicating the first air inlet cavity with the second air inlet cavity, and the bottom portion of the bottom cap is further provided with a second suction sensing air passage for communicating the second air inlet cavity with the first suction sensing air passage.

2. The electronic cigarette having dual air passages according to claim 1, wherein a wall portion of the receiving portion is provided with an air intake hole for communicating with an air inlet gap.

3. The electronic cigarette having dual air passages according to claim 1, wherein the second suction sensing air passage is provided on one side of the bottom cap, the first suction sensing air passage is symmetrically disposed on two sides of the upper portion of the battery rod and respectively in communication with the suction sensor.

4. The electronic cigarette having dual air passages according to claim 1, wherein a liquid absorbent layer for absorbing droplets contained in vapor is provided between a top end of the cigarette liquid cup and a lower portion of the mouth piece.

5. The electronic cigarette having dual air passages according to claim 1, wherein an inner diameter of the vapor outlet tube gradually becomes greater from bottom to top, to allow a velocity of the vapor flowing out to be decreased and prevent the moisture contained in the vapor from forming droplets on a wall of the tube.

6. The electronic cigarette having dual air passages according to claim 1, wherein the heating assembly comprises a liquid guiding strip and a heating coil disposed on the liquid guiding strip, a protruding portion is provided in a middle of an upper portion of the vaporizing base, and the heating assembly is hung above the second air inlet passage of the protruding portion, a lower portion of the vaporizing tube is sleeved on an outer wall of the protruding portion of the vaporizing base, a vaporizing chamber, in which the cigarette liquid can be vaporized, is formed inside the vaporizing tube and between the protruding portion and the liquid isolation component.

7. The electronic cigarette having dual air passages according to claim 1, wherein a blind hole is provided at a bottom portion of the vaporizing base, and the blind hole serves to accommodate first positive and negative electrodes disposed on the bottom cap, a lead wire for the heating coil of the heating assembly is arranged within the blind hole, and the lead wire for the heating coil is connected with the first positive and negative electrodes.

8. The electronic cigarette having dual air passages according to claim 1, wherein the bottom cap comprises a base plate and comprise a surrounding wall perpendicularly formed on a periphery of the base plate, the first air inlet passage and the second suction sensing air passage respectively have a tube-shaped body disposed higher than the base plate and lower than a top of the surrounding wall.

9. The electronic cigarette having dual air passages according to claim 1, wherein the bottom cap is arranged with a liquid filling tube which extends through the vaporizing base and in communication with the liquid storage chamber, and the liquid filling tube is arranged with a removable plug disposed at the bottom portion of the bottom cap.

10. The electronic cigarette having dual air passages according to claim 1, wherein an outer wall of the vaporizing tube is directly contacted with the cigarette liquid inside the liquid storage chamber, the vaporizing tube is made of a material with good heat conductivity to transmit heat energy inside the vaporizing chamber to the cigarette liquid and reduce a viscosity of the cigarette liquid having relatively high viscosity.

* * * * *